US007189155B2

(12) United States Patent
Hoshino et al.

(10) Patent No.: US 7,189,155 B2
(45) Date of Patent: Mar. 13, 2007

(54) POLISHING BODY, POLISHING APPARATUS, SEMICONDUCTOR DEVICE, AND SEMICONDUCTOR DEVICE MANUFACTURING METHOD

(75) Inventors: Susumu Hoshino, Kawasaki (JP); Isao Sugaya, Kawasaki (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 11/002,655

(22) Filed: Dec. 3, 2004

(65) Prior Publication Data

US 2005/0142989 A1 Jun. 30, 2005

Related U.S. Application Data

(63) Continuation-in-part of application No. PCT/JP03/07854, filed on Jun. 20, 2003.

(30) Foreign Application Priority Data

Jun. 20, 2002 (JP) ..... 2002-179323

(51) Int. Cl.
*B24B 1/00* (2006.01)

(52) U.S. Cl. ..... 451/527; 451/533

(58) Field of Classification Search ..... 451/41, 451/526, 527, 528, 529, 530, 533, 534, 537
See application file for complete search history.

(56) References Cited

U.S. PATENT DOCUMENTS

| | | | | |
|---|---|---|---|---|
| 5,287,663 | A | 2/1994 | Pierce et al. | |
| 5,564,965 | A | 10/1996 | Tanaka et al. | |
| 5,882,251 | A | 3/1999 | Berman et al. | |
| 5,921,855 | A | 7/1999 | Osterheld et al. | 451/527 |
| 5,984,769 | A | 11/1999 | Bennett et al. | 451/527 |
| 6,402,591 | B1 | 6/2002 | Thornton | |
| 6,551,179 | B1 * | 4/2003 | Halley | 451/285 |
| 6,561,891 | B2 * | 5/2003 | Eppert et al. | 451/530 |
| 6,869,343 | B2 * | 3/2005 | Suzuki | 451/178 |
| 2003/0003857 | A1 * | 1/2003 | Shimagaki et al. | 451/534 |
| 2005/0142989 | A1 * | 6/2005 | Hoshino et al. | 451/41 |

FOREIGN PATENT DOCUMENTS

| | | |
|---|---|---|
| EP | 1 408 538 A1 | 4/2004 |
| JP | 11-156701 | 6/1999 |
| JP | 2001-121405 | 5/2001 |
| JP | 2001-277102 | 10/2001 |
| JP | 2002-28849 | 1/2002 |
| JP | 2002-75933 | 3/2002 |
| WO | WO 00/12642 | 3/2000 |

* cited by examiner

*Primary Examiner*—Jacob K. Ackun, Jr.
(74) *Attorney, Agent, or Firm*—Morgan, Lewis & Bockius, LLP

(57) ABSTRACT

The polishing body is attached to a substrates. The polishing body has a structure in which a polishing pad, a hard elastic member and a soft members are laminated in that order from the side of the polishing surface. For example, an IC1000 (commercial name) manufactured by Rodel, Inc. is used as the polishing pad. For example, a stainless steel plate is used as the hard elastic member. A Suba400 (commercial name) manufactured by Rodel, Inc. is used as the soft members. The polishing pad 6 has grooves in the polishing surface side. The residual thickness d of the areas of the grooves in the polishing pad is set so as to satisfy the condition 0 mm<d≦0.6 mm. As a result, the ability to eliminate steps can be increased, thus allowing the "local pattern flatness" to be improved, while ensuring the "global removal uniformity"; furthermore, a polishing body with a long useful life can be obtained.

11 Claims, 4 Drawing Sheets

POLISHING BODY, POLISHING APPARATUS, SEMICONDUCTOR DEVICE, AND SEMICONDUCTOR DEVICE MANUFACTURING METHOD

This is a continuation-in-part from PCT International Application No. PCT/JP2003/007854 filed on Jun. 20, 2003, which is hereby incorporated by reference.

TECHNICAL FIELD

The present invention relates to a polishing body which is used in the polishing of objects such as semiconductor wafers, e.g. wafers that have semiconductor circuits or the like formed inside, a polishing apparatus using this polishing body, a semiconductor device manufacturing method using this polishing apparatus, and a semiconductor device.

BACKGROUND ART

As semiconductor integrated circuits have become finer and more highly integrated, the steps of semiconductor manufacturing processes have become more numerous and complex. Consequently, the surfaces of semiconductor devices are not always flat. The presence of steps in the surfaces of semiconductor devices leads to step breakage in wiring, and local increases in resistance and may cause wire breakage and a drop in electrical capacity. Furthermore, in the insulating films, this may lead to a deterioration in the withstand voltage and the occurrence of leakage, etc.

Meanwhile, as semiconductor integrated circuits have become finer and more highly integrated, the light source wavelengths of semiconductor exposure apparatuses used in photolithography have become shorter, and the numerical aperture or so-called NA of the projection lenses of semiconductor exposure apparatuses has become larger. As a result, the focal depths of the projection lenses of semiconductor exposure apparatuses have become substantially shallower. In order to handle such shallow focal depths, there has been a need for a greater degree of flattening of the surfaces of semiconductor devices than in the past.

One of the methods known in the art for polishing process wafers, which are, for example, wafers that have semiconductor circuits formed inside, is CMP (chemical mechanical polishing or planarization). CMP is particularly efficient technique for flattening large areas (at the die size level). CMP is a process in which the surface layer of a process wafer is removed by the combined action of a chemical effect and physical polishing, and is an important technique for global flattening and electrode formation. The process uses a polishing agent called a slurry. The slurry is formed by dispersing polishing particles (generally silica, alumina or cerium oxide, etc.) in a solubilizing solvent such as an acidic or alkaline. In CMP, polishing is caused by pressing the surface of the wafer with the polishing pad of the polishing tool, which has a polishing pad, thus causing friction by the relative motion.

Unlike a wafer in a blank state, the surface of a patterned wafer is not flat. In particular, there are ordinarily steps between portions where chips are formed and portions where chips are not formed. Accordingly, in cases where such patterned wafers are polished, it is necessary to eliminate local indentations and projections (this is called "local pattern flatness") while performing uniform polishing (this is called "global removal uniformity") in accordance with large-period indentations and projections (undulations) in the wafer substrate, i.e., along such indentations and projections (undulations).

Conventionally, in order to meet such requirements, a so-called two-layer pad in which a hard polishing pad and a soft pad are bonded together has been used as a polishing body in the polishing tool, and this two-layer pad is bonded to the surface of a polishing platen which contains a rigid body so that the hard polishing pad is located on the side of the object of polishing. An IC1000 (commercial name) manufactured by Rodel, Inc. has been used as the hard polishing pad; grooves used for the supply and discharge of the polishing agent are formed in the surface of this pad. In the case of this hard polishing pad, the thickness of areas in which no grooves are formed is 1.27 mm, the depth of the grooves is approximately 0.6 mm, and the residual thickness in areas where grooves are formed is approximately 0.67 (=1.27−0.6) mm. Furthermore, sponge-form Suba400 (commercial name) manufactured by Rodel, Inc. has been used as the soft pad.

If a polishing body consisting of such a two-layer pad is used, since a soft pad is interposed between the hard polishing pad and the polishing platen, the soft pad is relatively susceptible to compressive deformation. Accordingly, the hard polishing pad undergoes deformation in accordance with the large undulations of the patterned wafer. Consequently, polishing can be performed with a fixed amount of polishing along the undulations of the patterned wafer. On the other hand, since the hard polishing pad is relatively resistant to deformation with respect to local indentations and projections, local indentations and projections can be removed by polishing.

However, there is now a requirement to increase the degree of integration of semiconductor integrated circuits to a point beyond that seen in the past, and to apply a finer wiring rule. Furthermore, there has been an increase in the demand for polishing system LSI, and the pattern density distribution of system LSI has become more severe.

Thus, in cases where patterned wafers that have patterns determined by a fine wiring rule or patterns with a severe density distribution formed inside are polished, even if conventional polishing bodies such as those described above are used, it is difficult to satisfy the requirements of both "global removal uniformity" and "local pattern flatness." Specifically, in these wafers, local indentations and projections tend to be large, and in cases where a conventional polishing body, such as that described above, is used the soft pad tends to undergo compressive deformation as the local indentations and projections increase, and the hard pad also undergoes deformation in accordance with this. As a result, the ability to eliminate steps is reduced, so that it becomes difficult to ensure "local pattern flatness."

Accordingly, the present invention relates to a polishing body that contains in order a polishing pad that has grooves formed in the surface, a hard elastic member and a soft member. For example, the hard elastic member is an elastic member with a Young's modulus of 10,000 kg/mm or greater. The soft member is a member with a compression rate of 10% or greater when pressed with a pressure of 1.0 $kg/cm^2$.

If this polishing body is used, since a hard elastic member is sandwiched between the polishing pad and the soft member, the ability to eliminate steps can be increased, thus improving the "local pattern flatness," while ensuring "global removal uniformity."

It is desirable that a hard pad be used as the polishing surface-side polishing pad that is employed in this polishing body. Accordingly, it is conceivable that an IC1000 (commercial name) manufactured by Rodel, Inc., in which the thickness of areas in which no grooves are formed is 1.27 mm, the depth of the grooves is approximately 0.6 mm, and the residual thickness of the areas in which grooves are formed is approximately 0.67 (=1.27−0.6) mm, might be used "as is" as the polishing pad on the polishing surface side of this polishing body in the same manner the hard pad of the conventional polishing body described above.

However, in a polishing body in which a hard elastic member is included, in spite of the fact that the polishing pad on the polishing surface side has an inherently long useful life in terms of the ability to eliminate steps, this polishing pad is subject to restrictions arising from the depth of the grooves in this polishing pad, so that the useful life of this polishing pad is shortened.

Specifically, the thickness of the polishing pad on the polishing surface side of the polishing body becomes smaller as a result of wear caused by polishing of the object of polishing and wear caused by dressing. Dressing is a treatment that eliminates clogging of the polishing surface, and is also called conditioning). Meanwhile, the grooves in the surface of the polishing pad are indispensable for the supply and discharge of the polishing agent during polishing, and if these grooves are eliminated or reduced to a specified depth or less, it becomes impossible to obtain the desired polishing characteristics. Accordingly, in cases where the IC1000, which has the thickness and groove depth described above, is used even if it is assumed that the useful life is not exhausted to the point where the grooves are eliminated, the useful life is exhausted at the point in time at which the thickness of areas in which no grooves are formed is reduced to a value of 0.67 (=1.27−0.6) mm. The polishing pad is no longer useful because of the restrictions arising from the fact that the grooves are indispensable. However, it has been ascertained that when a polishing body includes a hard elastic member, even if the thickness of the polishing pad on the side of the polishing surface is less that 0.67 (=1.27−0.6) mm, the ability of the polishing body to eliminate steps is actually slightly improved rather than diminished.

Thus, in a polishing body in which a hard elastic member is not included, if a conventional polishing pad is used "as is," the pad is subject to the restrictions of groove depth, so that the useful life is needlessly shortened.

Furthermore, a polishing body consisting of the two-layer pad described above is not as desirable as the polishing body that includes a hard elastic member. First, the two-layer pad's ability to eliminate steps is inferior to that of the polishing body with an interposed hard elastic member. Second, the ability of the two-layer pad to eliminate steps is further reduced as the thickness of areas in which no grooves are formed in the polishing pad on the polishing surface side becomes smaller. Therefore, even if an IC1000 with the thickness and groove depth described above is used, the pad is subject to restrictions from the standpoint of the ability to eliminate steps, so that the useful life is exhausted before the grooves disappear. Accordingly, in the case where a polishing body consists of a two-layer pad, the useful life cannot be extended at all even if the grooves in the polishing pad on the side of the polishing surface are made deeper.

DISCLOSURE OF THE INVENTION

The present invention was devised in the light of facts that were newly discovered as a result of research conducted by the present inventor (such as those described above). One object of the present invention is to provide a polishing body which can increase the ability to eliminate steps and improve "local pattern flatness" while ensuring "global removal uniformity," and which has a long useful life. Another object is to provide a polishing pad that can be used in this polishing body.

Furthermore, another object of the present invention is to provide a polishing apparatus that can polish an object of polishing with good efficiency, and that can reduce running costs.

Moreover, another object of the present invention is to provide a semiconductor device manufacturing method which makes it possible to manufacture semiconductor devices efficiently and at a low cost, and with an improved yield compared to conventional semiconductor device manufacturing methods, and a low-cost semiconductor device.

A first embodiment is a polishing body used in a polishing apparatus which polishes an object of polishing by causing relative motion between the polishing body and the object of polishing. The polishing apparatus applies a load between the polishing body and the object of polishing. While the load is being applied, a polishing agent is interposed between the polishing body and the object of polishing. The polishing body has the following structure, in order: a polishing pad with grooves formed in the polishing surface side, a hard elastic member and a soft member. Furthermore, the residual thickness d in the areas of the grooves in the polishing pad satisfies the condition 0 mm<d≦1.6 mm.

In this first embodiment, the hard elastic member is an elastic member with a Young's modulus of 10,000 kg/mm$^2$ or greater; a metal plate may be cited as a typical example. A stainless steel plate, can be used as the hard elastic member, and the thickness of this hard elastic member can be set, for example, at 0.1 mm to 0.94 mm. The soft member is a member with a compression rate of 10% or greater when pressed at a pressure of 1.0 kg/cm$^2$. A urethane elastic member containing gas bubbles, or a non-woven fabric may be cited as typical examples.

In this first embodiment, furthermore, the object of polishing is a patterned wafer such as a wafer that has semiconductor integrated circuits formed inside. The hard elastic member may be a member which is constructed so that the amount of deformation at the polishing load that is applied during the polishing of this patterned wafer is smaller than the LTV (local thickness variation) that is permitted in this patterned wafer at the maximum spacing of the pattern in this patterned wafer, and larger than the TTV (total thickness variation) that is permitted in this patterned wafer at the spacing corresponding to one chip. Here, the LTV refers to the local indentations and projections within one chip of the wafer, and the TTV refers to the indentations and projections in the wafer as a whole.

A second embodiment is similar to the first embodiment, except it is further characterized in that the residual thickness d satisfies the condition d≦0.27 mm.

A third embodiment is a polishing body used in a polishing apparatus which polishes an object of polishing by causing relative motion between the polishing body and the object of polishing. The polishing apparatus a plies a load between the polishing body and the object of polishing. While the load is being applied, a polishing agent is interposed between the polishing body and the object of polishing. The polishing body has the following structures in order: a polishing pad that has grooves formed in the polishing surface side, a hard elastic member and a soft member. Furthermore, the residual thickness d in the areas of the grooves in the polishing pad satisfies the following conditions: 0 mm<d≦1.6 mm when the thickness in the areas of the polishing pad other than the grooves is 2.5 mm to 5 mm, 0 mm<d≦0.6 mm when the thickness in the areas of the areas polishing pad other than the grooves is 0.9 mm or greater but less than 2.5 mm, and 0 mm<d≦0.27 mm when the thickness in the areas of the polishing pad other than the grooves is less than 0.9 mm.

A fourth embodiment is a polishing body used in a polishing apparatus which polishes an object of polishing by causing relative motion between the polishing body and the object of polishing. The polishing apparatus applies a load between the polishing body and the object of polishing. While the load is being applied, a polishing agent is interposed between the polishing body and the object of polishing. The polishing body has the following structure, order: a polishing pad with grooves formed in the polishing surface side, a hard elastic member and a soft member. Furthermore, the depth of the grooves is 0.3 mm or greater, and the residual thickness d of the areas of the grooves in the polishing pad is such that 0 mm<d.

A fifth embodiment is a polishing body used in a polishing apparatus which polishes an object of polishing by causing relative motion between the polishing body and the object of polishing. The polishing apparatus applies a load between the polishing body and the object of polishing. While the load is being applied, a polishing agent is interposed between the polishing body and the object of polishing. The polishing body has a the following structure, in order: a polishing pad with grooves formed in the polishing surface side, a hard elastic member and a soft member. Furthermore, the depth of the grooves is 0.7 mm or greater, and the residual thickness d in the areas of the grooves in the polishing pad is such that 0 mm<d.

A sixth embodiment that is similar to to any of the first, and the third through fifth embodiments, except it is further characterized in that the residual thickness d satisfies the condition 0.1 mm<d.

A seventh embodiment that is similar to any of the first, and the third through fifth embodiments, except it is further characterized in that the compression rate of the polishing pad when pressed with a pressure of 1.0 kg/cm$^2$ is 10% or less.

An eighth embodiment which uses the polishing body of the third embodiment except the residual thickness d in the areas of the grooves satisfies the following conditions: 0 mm<d≦1.6 mm when the thickness in the areas of the polishing pad other than the grooves is 2.5 mm to 5 mm, 0 mm<d≦0.6 mm when the thickness in the areas of the polishing pad other than the grooves is 0.9 mm or greater but less than 2.5 mm, and 0 mm<d≦0.27 mm when the thickness in the areas of the polishing pad other than the grooves is less than 0.9 mm.

A ninth embodiment is a polishing pad with grooves formed in the polishing surface side. The residual thickness d of the areas of the grooves satisfies the following conditions: 0 mm<d≦1.6 mm when the thickness in the areas of the polishing pad other than the grooves is 2.5 mm to 5 mm, 0 mm<d≦0.6 mm when the thickness in the areas of the polishing pad other than the grooves is 0.9 mm or greater but less than 2.5 mm, and 0 mm<d≦0.27 mm when the thickness in the areas of the polishing pad other than the grooves is less than 0.9 mm.

A tenth embodiment is similar to the fourth embodiment, except it is further characterized in that the depth of the grooves in the polishing pad is 0.3 mm or greater, and the residual thickness d in the areas of the grooves in the polishing pad is such that 0 mm<d.

An eleventh embodiment is a polishing pad with grooves formed in the polishing surface side. The depth of the grooves in the polishing pad is 0.3 mm or greater, and the residual thickness d in the areas of the grooves in the polishing pad is such that 0 mm<d.

A twelfth embodiment is similar to the fourth embodiment, except it is further characterized in that the depth of the grooves of the polishing pad is 0.7 mm or greater, and the residual thickness d in the areas of the grooves in the polishing pad is such that 0 mm<d.

A thirteenth embodiment is a polishing pad with grooves formed in the polishing surface side. The depth of the grooves of the polishing pad is 0.7 mm or greater, and the residual thickness d in the areas of the grooves in the polishing pad is such that 0 mm<d.

A fourteenth embodiment is similar to the embodiments of eight to thirteen, except it is further characterized in that the compression rate of the polishing pad when pressed with a pressure of 1.0 kg/cm$^2$ is 10% or less. A fifteenth embodiment, which uses the polishing body of any of the third through fifth embodiments is a polishing apparatus which polishes an object of polishing by causing relative motion between the polishing body and the object of polishing. The polishing apparatus applies a load between the polishing body and the object of polishing. While the load is being applied, a polishing agent is interposed between the polishing body and the object of polishing.

A sixteenth embodiment is a semiconductor device manufacturing method. This method has a process in which the surface of a semiconductor wafer is flattened using the polishing apparatus described in the fifteenth embodiment.

A seventeenth embodiment is a semiconductor device characterized in that this semiconductor device is manufactured by the semiconductor device manufacturing method described in the sixteenth embodiment.

BEST MODE FOR CARRYING OUT THE INVENTION

The polishing body, polishing apparatus, semiconductor device and semiconductor device manufacturing method constituting the inventions of the present application will be described below with reference to the figures.

Figure 1:
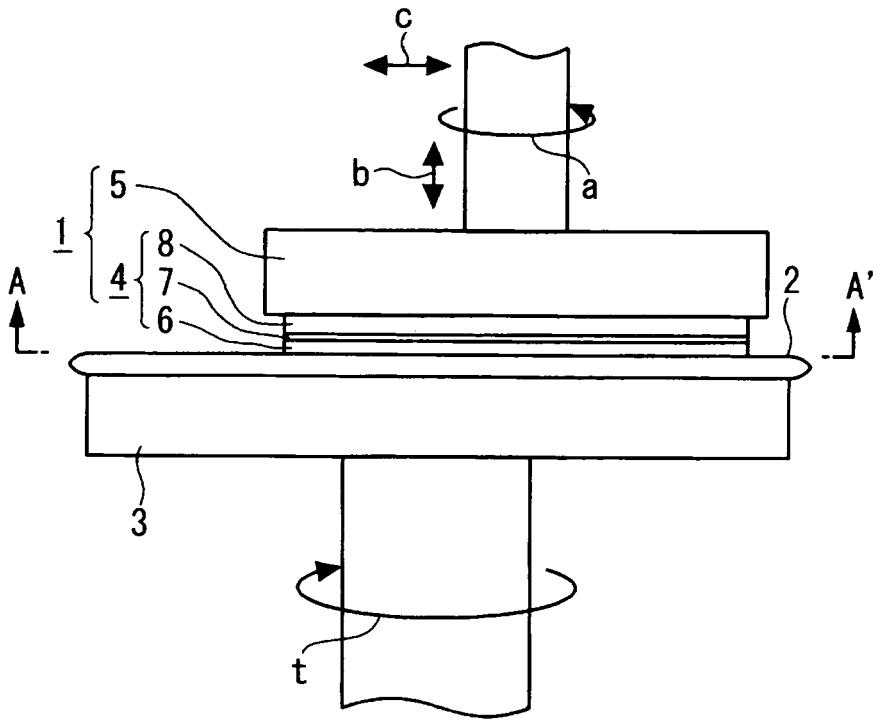
FIG. 1 is a schematic structural diagram which shows in model form a polishing apparatus constituting a working configuration of the present invention.
Figure 2:
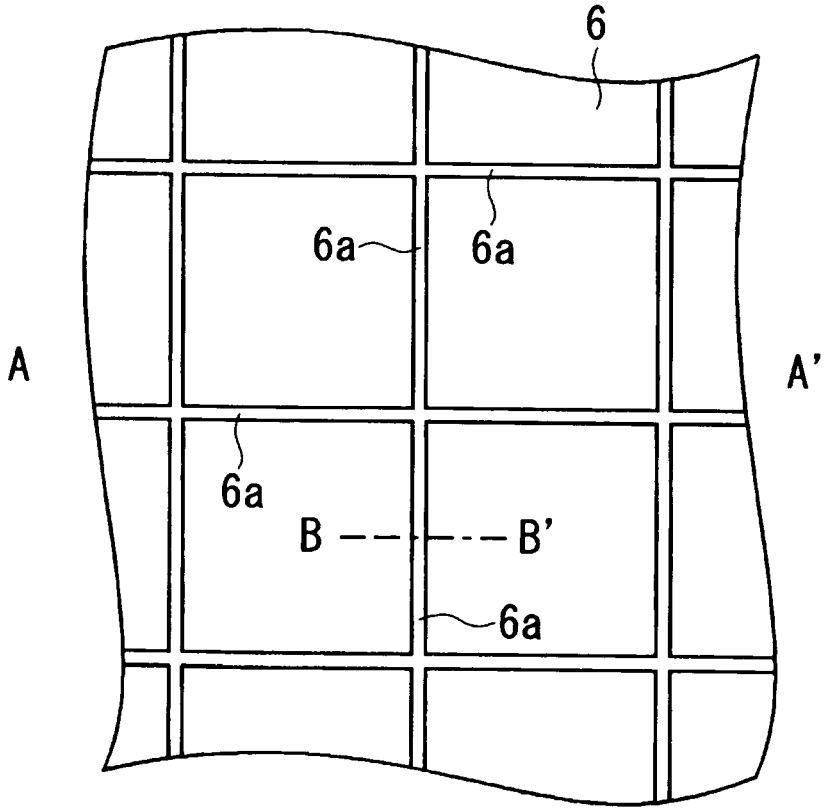
FIG. 2 is a partial enlarged diagram along the arrow view A—A' in FIG. 1.
Figure 3:
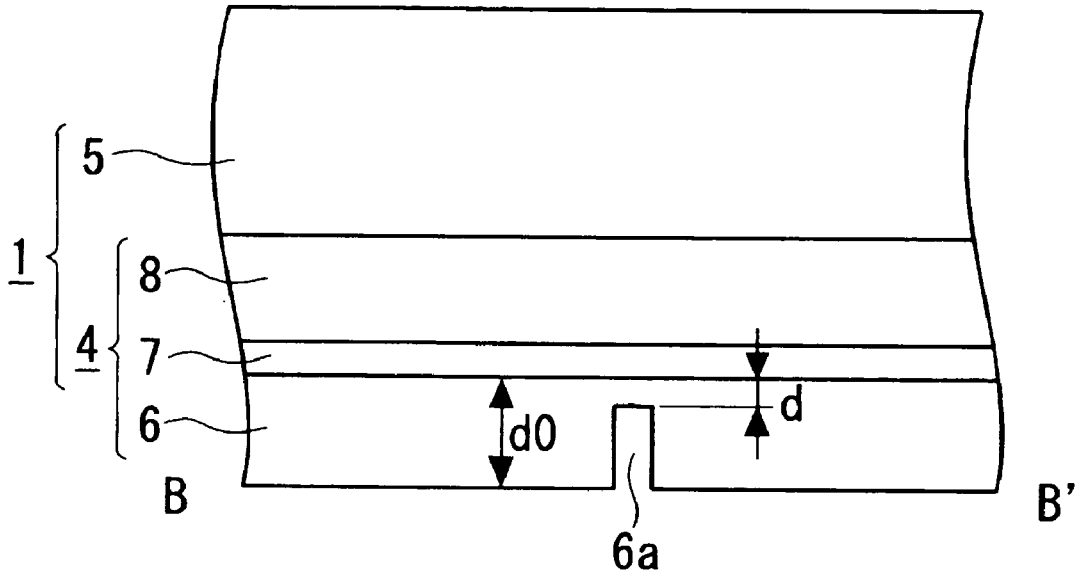
FIG. 3 is a schematic sectional view along line B—B' in FIG. 2.

FIG. 1 is a schematic structural diagram which shows in model form a polishing apparatus constituting a working configuration of the present invention. FIG. 2 is a partial enlarged diagram along the arrow view A—A' in FIG. 1. FIG. 3 is a schematic sectional view along line B—B' in FIG. 2.

The polishing apparatus constituting the present working configuration comprises a polishing tool 1, a wafer holder 3 which holds a wafer 2 as an object of polishing on the underside of the polishing tool 1, and a polishing agent supply part (not shown in the figures) which supplies a polishing agent (slurry) to the space between the wafer 2 and the polishing tool 1 via a supply path (not shown in the figures) formed in the polishing tool 1.

The polishing tool 1 is arranged so that this tool can perform a rotational motion, upward-downward motion and swinging motion (reciprocating motion) in the left-right direction by means of a mechanism (not shown in the figures) using an electric motor or the like as an actuator as indicated by arrows a, b and c in FIG. 1. The wafer holder 3 is arranged so that this wafer holder can be rotated as indicated by arrow t in FIG. 1 by means of a mechanism (not shown in the figures) using an electric motor or the like as an actuator.

The polishing tool 1 has a polishing body 4 and a substrate 5 which supports the surface on the opposite side from the polishing surface (undersurface in FIG. 1) in the polishing body 4 (i.e., the upper surface in FIG. 1). In the present working configuration, the diameter of the polishing body 4 is set at a diameter that is smaller than the diameter of the wafer 2, so that the footprint of the apparatus as a whole is small, and so that high-speed low-load polishing is facilitated. Of course, in the present invention, the diameter of the polishing body 4 may also be the same as or greater than the diameter of the wafer 2. The shape of the polishing body 4 (especially the polishing pad 6) as seen in a plan view may be (for example) a ring-form shape in which the portion in the vicinity of the center of rotation is removed, or may be a circular disk-form shape.

As is shown in FIGS. 1 and 3, the polishing body 4 has a structure in which a polishing pad 6, a hard elastic member 7 and a soft member 8 are laminated in that order from the side of the polishing surface. The polishing pad 6 and hard elastic member 7, the hard elastic member 7 and soft member 8, and the soft member 8 and substrate 5 can be respectively joined by bonding or the like using (for example) a bonding agent or a two-sided adhesive tape. When the useful life of the polishing pad 6 is exhausted, the polishing body 4 as a whole may be replaced, or the polishing pad 6 alone may be replaced.

It is desirable that the polishing pad 6 be a hard pad; for example, it is a pad with a compression rate of 10% or less when pressed with a pressure of 1.0 kg/cm$^2$. In concrete terms, for example, an IC1000 (commercial name) manufactured by Rodel, Inc. can be used as the polishing pad 6; however, the present invention is not limited to this.

As is shown in FIGS. 2 and 3, grooves 6*a* are formed in a lattice-form pattern in the polishing surface side of the polishing pad 6. Of course, the pattern of the grooves 6*a* is not limited to a lattice-form pattern; various types of patterns may be used.

The residual thickness d in the areas of the grooves 6*a* in the polishing pad 6 is set so as to satisfy the condition 0 mm$<$d$\leqq$0.6 mm. The residual thickness d in the areas of the grooves 6*a* in the polishing pad 6 may also be set so as to satisfy (for example) the condition 0 mm$<$d$\leqq$0.27 mm.

Alternatively, the residual thickness d in the areas of the grooves 6*a* in the polishing pad 6 may be set so that this residual thickness d satisfies the condition 0 mm$<$d$\leqq$1.6 mm when the initial thickness d0 in the areas of the polishing pad other than the grooves in the polishing pad 6 is 2.5 mm to 5 mm, so that this residual thickness d satisfies the condition 0 mm$<$d$\leqq$0.6 mm when the initial thickness d0 in the areas other than the grooves 6*a* is 0.9 mm or greater but less than 2.5 mm, and so that this residual thickness d satisfies the condition 0 mm$<$d$\leqq$0.27 mm when the initial thickness d0 in the areas other than the grooves 6*a* is less than 0.9 mm.

Furthermore, as long as the residual thickness in the areas of the grooves 6*a* in the polishing pad 6 is a value exceeding 0 mm, there is no separation by the grooves 6*a*; accordingly, handling in the bonding of the polishing pad 6 to the hard elastic member 7 is facilitated. If the residual thickness d is 0.1 mm or greater, the risk of inadvertent separation in the areas of the grooves 6*a* is eliminated; accordingly, such a thickness is more desirable.

The hard elastic member 7 is an elastic member with (for example) a Young's modulus of 10,000 kg/mm$^2$ or greater; a metal plate may be cited as a typical example. In concrete terms, a stainless steel plate, for instance, can be used as the hard elastic member 7, and the thickness of this plate can be set, for example, at 0.1 mm to 0.94 mm.

Furthermore, the hard elastic member 7 may also be constructed so that the amount of deformation in the polishing load that is applied during the polishing of the wafer 2 is smaller than the LTV that is permitted in the wafer 2 in the maximum spacing of the pattern in the wafer 2, and larger than the TTV that is permitted in the patterned wafer in the spacing corresponding to one chip.

The soft member 8 is a member which has (for example) a compression rate of 10% or greater when pressed with a pressure of 1.0 kg/cm$^2$. A urethane elastic member containing gas bubbles, or a non-woven fabric, etc., may be cited as typical examples. In concrete terms, a Suba400 (commercial name) manufactured by Rodel, Inc. can be used as the soft member 8.

The polishing of the wafer 2 constituting the present working configuration will be described here. While the polishing tool 1 rotates and swings, the polishing body 4 of the polishing tool 1 is pressed against the upper surface of the wafer 2 on the wafer holder 3 with a specified pressure (load). The wafer holder 3 is rotated, the wafer 2 is also rotated, and relative motion is caused to take place between the wafer 2 and polishing tool 1. In this state, a polishing agent is supplied to the space between the wafer 2 and polishing body 4 from the polishing agent supply part, and this polishing agent is caused to diffuse between these parts so that the surface of the wafer 2 that is to be polished is polished. Specifically, mechanical polishing caused by the relative motion of the polishing tool 1 and wafer 2 and the chemical effect of the polishing agent act synergistically, so that favorable polishing is performed. In this case, the grooves 6*a* in the polishing pad 6 of the polishing body 4 act to supply and discharge the polishing agent during polishing.

In the present working configuration, the polishing body 4 is constructed as a laminate of the polishing pad 6, hard elastic member 7 and soft member 8, and the hard elastic member 7 is sandwiched between the polishing pad 6 and soft member 8; accordingly, the ability to eliminate steps is increased, thus allowing the "local pattern flatness," to be improved, while ensuring the "global removal uniformity," compared to a case in which no hard elastic member 7 is interposed (i.e., a case in which the polishing body is constructed from a conventional two-layer pad that has a hard polishing pad and a soft pad bonded together).

The thickness of the areas other than the grooves 6*a* in the polishing pad 6 becomes smaller as a result of wear that accompanies the polishing of the wafer 2 and wear that accompanies dressing. In the present working configuration, unlike the case of the hard pad of a polishing body consisting of a conventional two-layer pad, the residual thickness d of the areas of the grooves 6*a* in the polishing pad 6 of the polishing body 4 is set as described above; accordingly, the restrictions on the depth of the grooves 6*a* are eased, so that the needless reduction in the useful life of the polishing pad 6 is ameliorated, thus extending the useful life. Consequently, in the present working configuration, the wafer 2 can be efficiently polished, and the running costs can be reduced.

Figure 4:
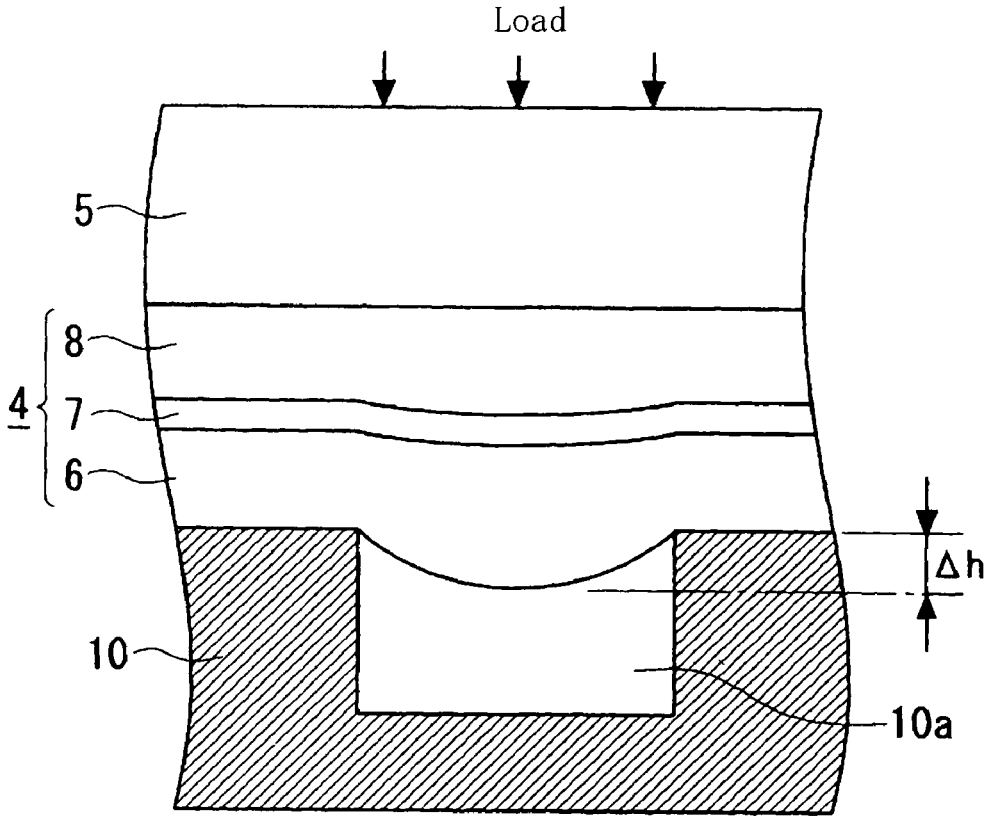
FIG. 4 is a schematic sectional view which shows an analytical model in model form.
Figure 5:
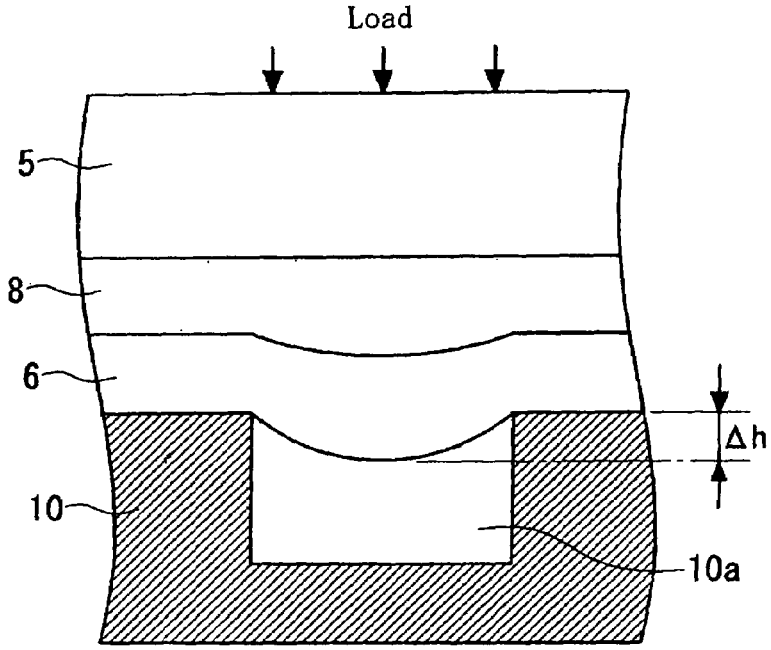
Fig.5 RELATED ART
FIG. 5 is a schematic sectional view which shows another analytical model in model form.
Figure 6:
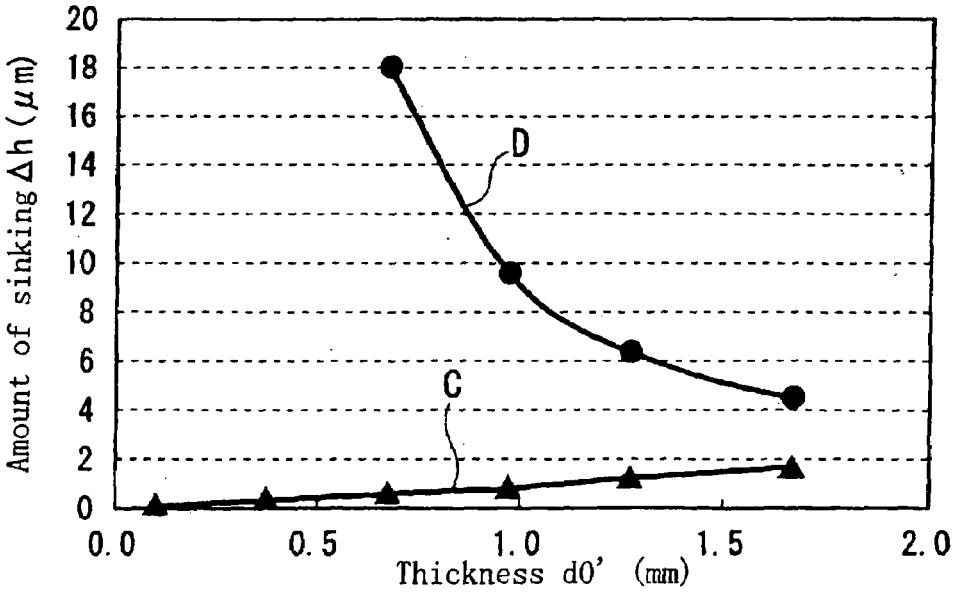
FIG. 6 is a diagram which shows the analysis results of the models shown in FIGS. 4 and 5.

With regard to this point, an analysis using the finite element method was done for the model shown in FIG. 4 and the model shown in FIG. 5, and obtained the analysis results shown in FIG. 6. In FIGS. 4 and 5, the same symbols are assigned to elements that are the same as elements shown in FIGS. 1 and 3, or that correspond to elements shown in FIGS. 1 and 3. FIGS. 4 and 5 are schematic sectional views that show the analytical models in model form.

In the model shown in FIG. 4, the substrate 5 was assumed to be a completely rigid body. The soft member 8 was a Suba400 (commercial name) manufactured by Rodel, Inc., and was assumed to have a thickness of 1.27 mm when no load was applied. The hard elastic member 7 was a stainless steel plate with a thickness of 0.2 mm. The polishing pad 6 was an IC1000 (commercial name) manufactured by Rodel, Inc., and the thickness of this pad with no load applied was d0'. The polishing pad 6 was a pad with no grooves 6*a*. A completely rigid body 10 which had a flat upper surface and which had sufficiently deep holes 10*a* (4×4 mm square as seen in a plan view) in the upper surface was envisioned as a substitute for the wafer 2. The thickness d0' of the polishing pad 6 was varied, and the amount of sinking Ah of the polishing pad 6 into the holes 10*a* when a load of 200 gf/cm$^2$ was applied to the substrate 5 from above was calculated for various thicknesses d0' using the finite element method. The analysis results thus obtained for the analytical model shown in FIG. 4 are indicated by line C in FIG. 6. The analytical model shown in FIG. 4 corresponds to the polishing body 4 of the working configuration described above.

The model shown in FIG. 5 differs from the model shown in FIG. 4 only in that the hard elastic member 7 is eliminated. The other conditions of the model shown in FIG. 5 are absolutely the same as the case of the model shown in FIG. 4; the amount of sinking Ah of the polishing pad 6 into the holes 10*a* was calculated for various thicknesses d0' (i.e., with the thickness d0' of the polishing pad 6 varied) using the finite element method. The analysis results thus obtained for the analytical model shown in FIG. 5 are indicated by line D in FIG. 6. The analytical model shown in FIG. 5 corresponds to the conventional polishing body consisting of the two-layer pad described above.

In the models shown in FIGS. 4 and 5, the magnitude of the amount of sinking Ah serves as an indicator of the ability to eliminate steps in the object of polishing such as a wafer 2; as the amount of sinking Ah increases, the ability to eliminate steps drops, and conversely, as the amount of sinking Ah decreases, this means that the ability to eliminate steps is increased.

As is clear from FIG. 6, in the case of the model shown in FIG. 4 corresponding to the polishing body 4 of the working configuration described above, the amount of sinking Ah is sufficiently small, and the ability to eliminate steps is high over the respective thicknesses d0' of the polishing pad 6; furthermore, the ability to eliminate steps is conversely slightly increased rather than dropping as the thickness d0' becomes smaller. It is thought that this is due to the fact that the effect of the hard elastic member 7 becomes a governing factor as the polishing pad 6 becomes thinner. Furthermore, as is shown by C in FIG. 6, the ability to eliminate steps is improved even if the thickness d0' of the polishing pad 6 becomes smaller than 0.67 (=1.27−0.6) mm.

On the other hand, in the case of the model shown in FIG. 5 corresponding to the conventional polishing body consisting of the two-layer pad described above, it is seen that the amount of sinking Ah is large, and the ability to eliminate steps is low to begin with over the respective thicknesses d0' of the polishing pad 6, and that the amount of sinking Ah increases abruptly as the thickness d0' becomes smaller, so that the ability to eliminate steps shows a large abrupt drop.

Accordingly, from the analysis results shown in FIG. 6, it is seen that in the case of the conventional polishing body consisting of the two-layer pad described above, restrictions are created on the useful life of the polishing pad 6 from the standpoint of the ability to eliminate steps, while in the case of the polishing body 4 of the working configuration described above, the useful life of the polishing pad 6 is not restricted from the standpoint of the ability to eliminate steps.

Accordingly, it is seen that in the case of the polishing body 4 of the working configuration described above, as the initial depth of the grooves 6*a* in the polishing pad 6 of the polishing body 4 is made greater with the residual thickness d of the areas of the grooves 6*a* in the polishing pad 6 made as small as possible, the restriction on the useful life caused by the grooves 6*a* is ameliorated, so that the useful life of the polishing pad 6 is extended. Consequently, in the present working configuration, since the residual thickness d of the areas of the grooves 6*a* in the polishing pad 6 of the polishing body 4 is set as described above, the useful life of the polishing pad 6 can be extended compared to a case in which an existing IC1000 (commercial name) with grooves manufactured by Rodel, Inc. is used "as is" as the polishing pad 6.

Furthermore, in the case of the conventional polishing body consisting of the two-layer pad described above, since the useful life of the polishing pad is restricted from the standpoint of the ability to eliminate steps, the useful life of the polishing pad 6 cannot be extended no matter how small the residual thickness of the areas of the grooves is made.

Figure 7:
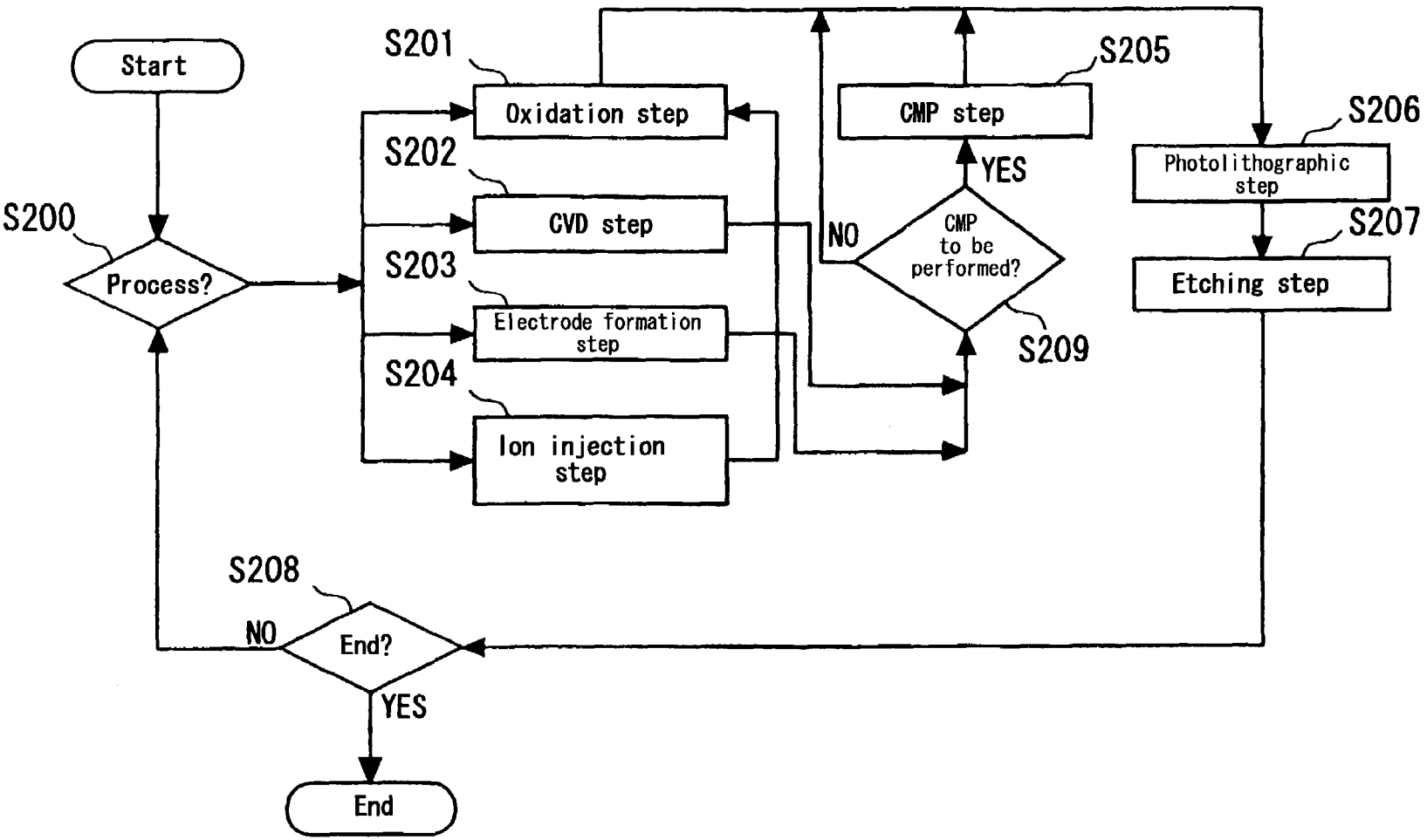
FIG. 7 is a flow chart which shows the semiconductor device manufacturing process.

Next, a working configuration of the semiconductor device manufacturing method of the present invention will be described. FIG. 7 is a flow chart which shows a semiconductor device manufacturing process. When the semiconductor device manufacturing process is started, the appropriate treatment process is first selected in step S200 from the following steps S201 through S204. Then, the processing proceeds to one of the steps S201 through S204 in accordance with this selection.

Step S201 is an oxidation process which oxidizes the surface of the silicon wafer. Step S202 is a CVD process in which an insulating film is formed on the surface of the silicon wafer by CVD, etc. Step S203 is an electrode formation process in which electrode films are formed on the silicon wafer by a process such as vacuum evaporation. Step S204 is an ion injection process in which ions are injected into the silicon wafer.

Following the CVD process or electrode formation process, the processing proceeds to step S209, and a judgment is made as to whether or not a CMP process is to be performed. In cases where such a process is not to be performed, the processing proceeds to step S206; on the other hand, in cases where such a process is to be performed, the processing proceeds to step S205. Step S205 is a CMP process; in this process, the flattening of inter-layer insulating films, or the formation of a damascene by the polishing of a metal film on the surface of the semiconductor device, etc., is performed using the polishing apparatus of the present invention.

Following the CMP process or oxidation process, the processing proceeds to step S206. Step S206 is a photolithographic process. In this photolithographic process, the coating of the silicon wafer with a resist, the burning of a circuit pattern onto the silicon wafer by exposure using an exposure apparatus, and the development of the exposed silicon wafer, are performed. Furthermore, the subsequent step S207 is an etching process in which the portions other than the developed resist image are removed by etching, the resist is then stripped away, and etching is completed, so that the unnecessary resist is removed.

Next, in step S208, a judgment is made as to whether or not all of the required processes have been completed. If the processes have not been completed, the processing returns to step S200, and the steps described above are repeated so that a circuit pattern is formed on the silicon wafer. If it is judged in step S208 that all of the processes have been completed, the processing is ended.

In the semiconductor device manufacturing method of the present invention, since the polishing apparatus of the present invention is used in the CMP process, the wafer 2 can be polished to a flat surface with a high degree of precision. Accordingly, the following effect is obtained: namely, the yield of the CMP process can be increased, so that semiconductor devices can be manufactured at a lower cost than in conventional semiconductor device manufacturing methods. Furthermore, since the useful life of the polishing pad 6 of the polishing body 4 is long, the wafer 2 can be polished to a flat surface with a high efficiency, so that semiconductor devices can be manufactured at a low cost from this standpoint as well.

Furthermore, the polishing apparatus of the present invention may also be used in the CMP process of semiconductor device manufacturing processes other than the semiconductor device manufacturing process described above.

The semiconductor device of the present invention is manufactured by the semiconductor device manufacturing method of the present invention. As a result, the semiconductor device can be manufactured at a lower cost than in a conventional semiconductor device manufacturing method, so that the following merit is obtained: namely, the base cost of manufacture of the semiconductor device can be reduced.

Working configurations of the present invention were described above, but the present invention is not limited to these working configurations.

The invention claimed is:

1. A polishing body comprising, in order:

a polishing pad with grooves formed in a polishing surface side, a hard elastic member, which is a metal plate, and a soft member, wherein a residual thickness d in areas of the grooves in the polishing pad satisfies the condition 0 mm<d≦1.6 mm.

2. The polishing body according to claim 1, wherein the residual thickness d satisfies the condition d≦0.27 mm.

3. The polishing body according to claim 1, wherein the metal plate is a stainless steel plate.

4. A polishing body comprising, in order:

a polishing pad with grooves formed in a polishing surface side, a hard elastic member, which is a metal plate, and a soft member, wherein a residual thickness d in areas of the grooves in the polishing pad satisfies the following conditions:

0 mm<d≦1.6 mm when a thickness of the areas of the polishing pad other than the grooves in the polishing pad is 2.5 mm to 5 mm, 0 mm<d≦0.6 mm when the thickness of the areas of the polishing pad other than the grooves is 0.9 mm or greater but less than 2.5 mm, and 0 mm<d≦0.27 mm when the thickness of the areas of the polishing pad other than the grooves is less than 0.9 mm.

5. The polishing body according to claim 4, wherein the metal plate is a stainless steel plate.

6. A polishing body comprising, in order:

a polishing pad with grooves formed in a polishing surface side, a hard elastic member, which is a metal plate, and a soft member, wherein a depth of the grooves is 0.3 mm or greater, and a residual thickness d in areas of the grooves in the polishing pad is such that 0 mm<d.

7. The polishing body according to claim 6, wherein the metal plate is a stainless steel plate.

8. A polishing body comprising, in order, a polishing pad with grooves formed in a polishing surface side, a hard elastic member, which is a metal plate, and a soft member, wherein a depth of the grooves is 0.7 mm or greater, and a residual thickness d in areas of the grooves in the polishing pad is such that 0 mm<d.

9. The polishing body according to claim 8, wherein the metal plate is a stainless steel plate.

10. The polishing body according to any one of claim 1, and claims 4, 6 and 8, wherein the residual thickness d satisfies the condition 0.1 mm≦d.

11. The polishing body according to any one of claim 1, and claims 4, 6 and 8, wherein a compression rate of the polishing pad when pressed with a pressure of 1.0 kg/cm$^2$ is 10% or less.

* * * * *